US009328724B2

(12) United States Patent
Asai

(10) Patent No.: US 9,328,724 B2
(45) Date of Patent: May 3, 2016

(54) ROCKING PISTON TYPE COMPRESSOR

(75) Inventor: Masatoshi Asai, Tokyo (JP)

(73) Assignee: MAX CO., LTD., Tokyo (JP)

( * ) Notice: Subject to any disclaimer, the term of this patent is extended or adjusted under 35 U.S.C. 154(b) by 865 days.

(21) Appl. No.: 13/181,545

(22) Filed: Jul. 13, 2011

(65) Prior Publication Data

US 2012/0020821 A1 Jan. 26, 2012

(30) Foreign Application Priority Data

Jul. 23, 2010 (JP) ..... 2010-166313

(51) Int. Cl.

| | |
|---|---|
| ***F04B 53/14*** | (2006.01) |
| ***F04B 39/04*** | (2006.01) |
| ***F04B 39/00*** | (2006.01) |
| ***F04B 43/00*** | (2006.01) |

(52) U.S. Cl.

CPC ..... *F04B 39/042* (2013.01); *F04B 39/0005* (2013.01); *F04B 43/0018* (2013.01); *F04B 53/143* (2013.01)

(58) Field of Classification Search

CPC ..... F16J 1/0008; F16J 9/08; F16J 1/008; F04B 43/0018; F04B 53/02; F04B 39/0005; F04B 39/042; F04B 53/143

USPC ..... 92/182, 250

See application file for complete search history.

(56) References Cited

U.S. PATENT DOCUMENTS

| | | | | | |
|---|---|---|---|---|---|
| 2,774,639 | A | * | 12/1956 | Naab | 277/451 |
| 3,224,378 | A | * | 12/1965 | Graham | 417/511 |
| 3,603,215 | A | | 9/1971 | Leschisin | |
| 3,947,157 | A | | 3/1976 | Leschisin | |
| 2007/0264141 | A1 | * | 11/2007 | Chou | 417/545 |

FOREIGN PATENT DOCUMENTS

| | | | |
|---|---|---|---|
| DE | 7919989 | U1 | 11/1979 |
| DE | 29 15 848 | A1 | 11/1980 |
| DE | 20 2005 000 855 | U1 | 3/2005 |
| GB | 844 998 | A | 8/1960 |
| GB | 2 156 481 | A | 10/1985 |
| JP | 9-68279 | | 3/1997 |
| JP | A-H11-325245 | | 11/1999 |
| JP | A-2004-190625 | A | 7/2004 |

OTHER PUBLICATIONS

Office Action dated Jun. 24, 2015 that issued in corresponding European Patent Application No. 11005520.9.

* cited by examiner

*Primary Examiner* — Edward Look
*Assistant Examiner* — Abiy Teka
(74) *Attorney, Agent, or Firm* — Drinker Biddle & Reath LLP

(57) ABSTRACT

A rocking piston type compressor is provided with a piston rod, a lip ring, and a ring holding member. The lip ring includes a center portion fixed by the ring holding member, and a lip portion upwardly extending around the center portion along a periphery of the ring holding member. The ring holding member includes a flange portion covering at least a part of an upper end surface of lip portion. A back pressure introducing portion is provided in a part of the flange portion.

6 Claims, 9 Drawing Sheets

ROCKING PISTON TYPE COMPRESSOR

BACKGROUND OF THE INVENTION

1. Field of the Invention

The present invention relates to a rocking piston type compressor.

2. Related Art

A rocking piston type compressor includes a piston rod that reciprocates in a cylinder while rocking by means of a connecting rod connected to a crank shaft. In the rocking piston type compressor, a lip ring is provided at a leading end portion of the piston rod, and the lip ring creates a seal between the cylinder and the piston rod.

The lip ring, when continuing to be used, is affected by compression heat or pressing load against a cylinder wall surface thereby to deform, or becomes worn due to the continuous use, so that a seal performance lowers and compression efficiency lowers gradually.

In order to prevent the seal performance of the lip ring from lowering, JP-A-09-068279 discloses a structure in which a lip portion of a piston ring is urged toward a cylinder by an urging member, thereby to create a seal between a piston body and the cylinder.

The lip ring is fixed to the piston rod by a ring holding member, and a clearance is provided between the lip ring and the ring holding member. Therefore, when the rocking piston slides in a compression direction, a pressurized air enters between the lip ring and the ring holding member, and back pressure is applied to the lip ring from an inner periphery thereof, so that the seal performance of the lip ring can be enhanced.

However, in case that the back pressure is too high, a load is applied onto the lip ring due to rapid pressure variation and compression heat, and deformation and abrasion are produced, which causes decrease of the seal performance of the lip ring.

Further, in case that damage of the lip ring results from the deformation and the abrasion, the damage is frequently inflicted further on surrounding parts. Since a load on the lip ring becomes largest in a rocking direction of the piston rod, the lip ring is frequently damaged on a side in the rocking direction of the piston rod. If the lip ring is damaged in the rocking direction of the piston rod, the rocking piston rod comes into direct contact with the cylinder (the lip ring cannot absorb the impact), which causes damage of the piton rod and the cylinder, or damage/breakdown of a bearing or a pressure meter due to vibration resulted from the contact between the piston rod and the cylinder.

SUMMARY OF THE INVENTION

One or more embodiments of the invention provide a structure in which a seal performance of a lip ring can be improved by facilitating a transmission of back pressure to an inner periphery of the lip ring, and damage of the lip ring can be prevented by preventing the back pressure from becoming too high.

In accordance with one or more embodiments of the invention, a rocking piston type compressor may include a piston rod 11 which is slidable while rocking in a cylinder 10, a lip ring 20 provided at a leading end portion 13 of the piston rod 11 and configured to seal between the cylinder 10 and the piston rod 11, and a ring holding member 30 provided at the leading end portion 13 of the piston rod 11 and configured to fixing the lip ring 20 to the piston rod 11. The lip ring 20 may include a center portion 21 fixed by the ring holding member 30, and a lip portion 22 upwardly extending around the center portion 21 along a periphery of the ring holding member 30.

The ring holding member 30 may include a flange portion 33 covering at least a part of an upper end surface 23 of lip portion 22. A back pressure introducing portion 34, 35, 37 may be provided in a part of the flange portion 33.

Other aspects and advantages of the invention will be apparent from the following description and the appended claims.

BRIEF DESCRIPTION OF THE DRAWINGS

FIG. 2(*b*) is a partially enlarged view of a longitudinal section of a piston rod leading end portion (which is a section taken along a line A-A of FIG. 2(*a*)).

FIG. 4(*b*) is a partially enlarged view of a longitudinal section of a piston rod leading end portion (which is a section taken along a line B-B of FIG. 4(*a*)).

FIG. 5(*b*) is a partially enlarged view of a longitudinal section of a piston rod leading end portion (which is a section taken along a line C-C of FIG. 5(*a*)).

FIG. 6(*b*) is a partially enlarged view of a longitudinal section of a piston rod leading end portion (which is a section taken along a line D-D of FIG. 6(*a*)).

FIG. 7(*b*) is a partially enlarged view of a longitudinal section of a piston rod leading end portion (which is a section taken along a line E-E of FIG. 7(*a*)).

FIG. 9(*b*) is a partially enlarged view of a transverse section of the piston rod leading end portion (section taken along a line G-G in FIG. 8).

DETAILED DESCRIPTION OF EXEMPLARY EMBODIMENT

Exemplary embodiments and modifications thereof will be described hereinbelow with reference to the drawings. Further, the exemplary embodiments and the modifications are not intended to limit the invention but to serve as examples thereof, and all features or combinations thereof described are not always essential to the invention.

(First Exemplary Embodiment)

A first exemplary embodiment of the invention will be described with reference to drawings.

Figure 1:
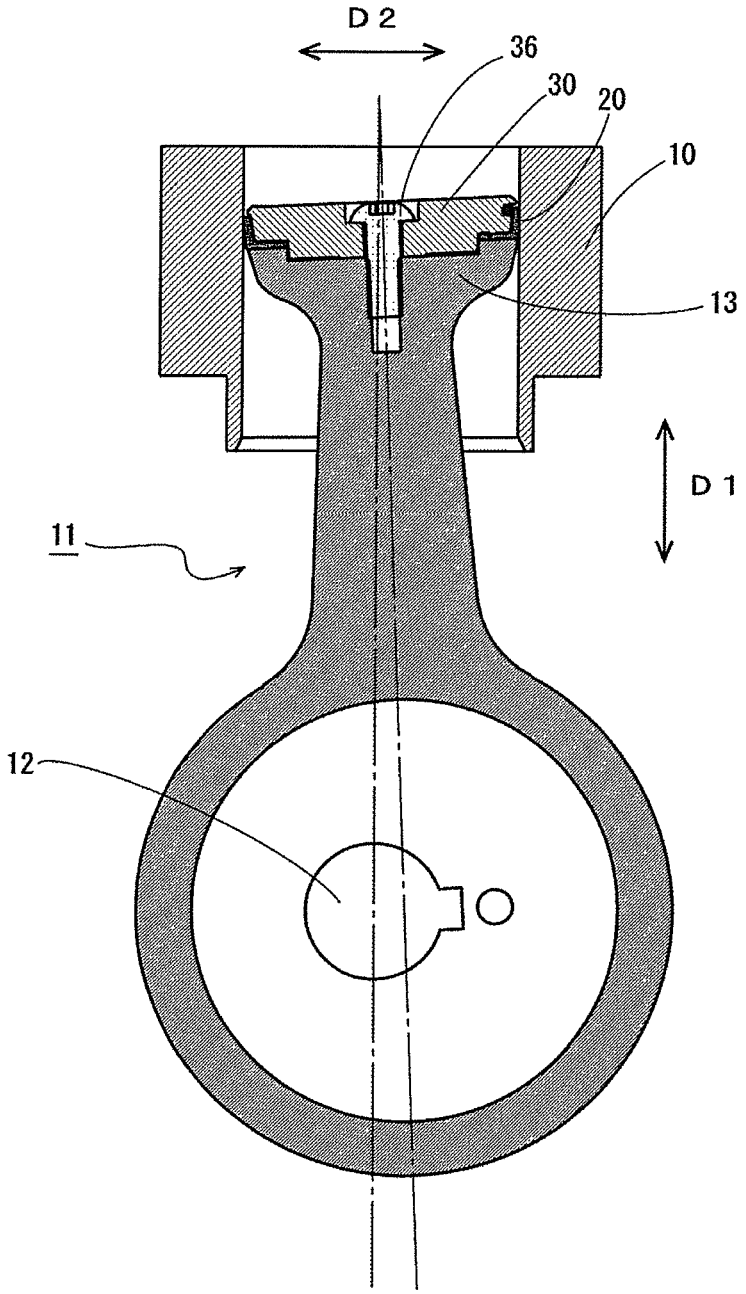
FIG. 1 is a longitudinal sectional view of a rocking piston in a first exemplary embodiment of the invention.

A rocking piston according to the present embodiment is provided in a compressor. As shown in FIG. 1, a piston rod 11 is accommodated in a cylinder 10.

The piston rod 11 is formed so as to be able to slide while rocking in the cylinder 10. At a leading end portion 13 of this piston rod 11, a plate-shaped piston portion is formed. Further, in a bearing hole 12 formed in an eccentric position of a base portion (large end portion) of this piston rod 11, a crank shaft (not shown) provided in the compressor body is supported, and this crank shaft is operation-connected to a rotation driving device (not shown) provided in the compressor body.

Therefore, the operation of the rotation driving device rotates the crank shaft thereby to subject the base portion of the piston rod to eccentric motion, whereby the leading end portion 13 of the piston rod 11 reciprocates in a sliding direction (direction D1 in FIG. 1). Namely, in the compressor according to this embodiment, the piston rod 11 is reciprocated by the rotation of crank shaft thereby to compress the air introduced in the cylinder 10, and to send out the air toward various devices or tools which operate by the compressed air.

For the piston rod 11 according to the embodiment, the piston portion is provided integrally as shown in FIG. 1. Therefore, with such the reciprocating motion of the piston rod 11 as described above, the leading end portion 13 of the piston rod 11 rocks in a direction orthogonal (direction D2 in FIG. 1) to the sliding direction.

In the embodiment, as shown in FIG. 1, at the leading end portion 13 of the piston rod 11, there is provided a lip ring 20 for creating a seal between the cylinder 10 and the piston rod 11. This lip ring 20 is pressed from the upside by a disc-shaped ring holding member 30 and fixed to the piston rod 11. Specifically, as shown in FIG. 1, the ring holding member 30 is fitted into a recess portion formed on the upper surface of the piston rod 11 so as to sandwich the lip ring 20 between the piston rod 11 and the member 30, and the ring holding member 30 is fixed to the upper surface of the piston rod 11 by a fixing bolt 36 inserted from the upside.

Figure 2A:
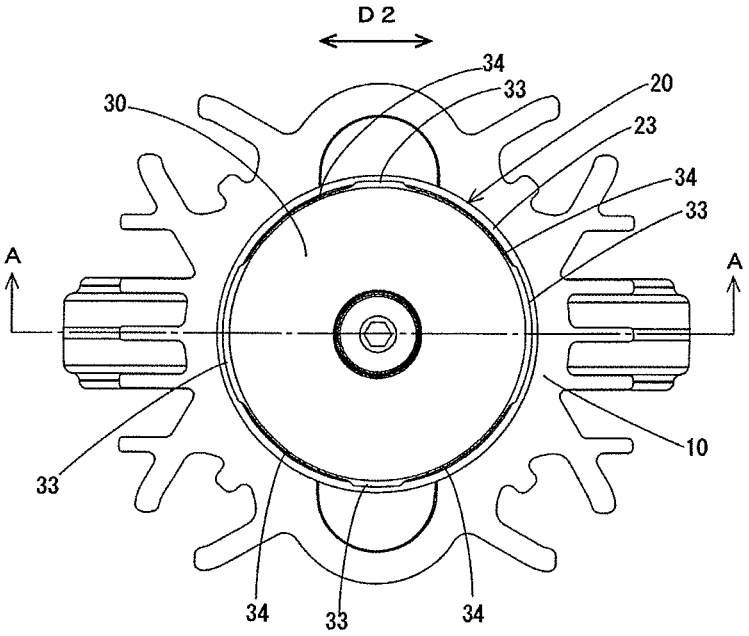
FIG. 2(*a*) is a plan view of a piston rod of the first exemplary embodiment.
Figure 2B:
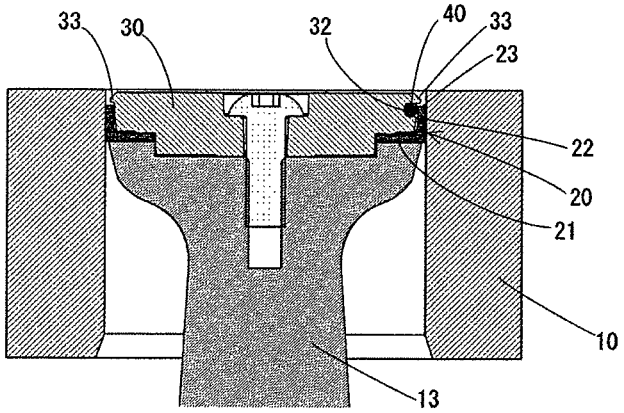

At this time, the lip ring 20, as shown in FIG. 2(*b*), is held at a center portion 21 thereof by the ring holding member 30 in the sandwich manner and fixed to the piston rod 11, and a lip portion 22 provided around this center portion 21 is formed so as to rise erectly along the periphery of the ring holding member 30. This lip ring 20 is formed of non-metallic material such as synthetic resin or synthetic rubber, and specifically non-metallic material composed of polytetrafluoro-ethylene or modified polytetrafluoro-ethylene, copper or bronze alloy powder, spherical carbon or carbon fiber, and molybdenum dioxide. The lip ring 20 is an annular member continuing seamlessly throughout the entire circumference. The lip portion 22 of this lip ring 20 deforms elastically in response to rocking of the leading end portion 13 of the piston rod 11, and seals surly clearance between the piston rod 11 and the cylinder 10.

On the other hand, the ring holding member 30 for fixing the above lip ring 20 to the piston rod 11, as shown in FIG. 2, has a flange portion 33 at its upper portion, and this flange portion 33 is protruded in the horizontal direction so as to cover a part of an upper end surface 23 of the lip portion 22. Further, this flange portion 33 has four notches 34 in the circumferential direction, and the upper end surface 23 of the lip portion 22 is, at this notch 34 portion, completely exposed in the radial direction. To be exact, as shown in FIG. 2(*a*), when projected in the direction vertical to the compression face (upper face) of the ring holding member 30, the flange portion 33 is extended up to the outside beyond the inner periphery edge of the upper end surface 23 of the lip portion 22. On the other hand, the flange portion 33 is notched, at the notch 34 portion, up to the inside of the inner periphery edge of the upper end surface 23 of the lip portion 22. In the embodiment, this notch 34 provides a back pressure introducing portion for making the pressurized air easy to enter inside the lip ring 20 when the rocking piston slides in the compression direction.

This notch 34 of the flange portion 33, as shown in FIG. 2(*a*), is not provided in the rocking direction D2 of the piston rod 11. Therefore, the upper end surface 23 of the lip portion 22 on both sides in this rocking direction D2 is covered partially with the flange portion 33. Namely, on both outsides in the rocking direction D2 of the piston rod 11 where the largest stress is produced by the reciprocating motion of the piston rod 11, the speed at which the pressurized air enters inside the lip ring 20 can be made low, so that a load due to rapid pressure variation and compression heat can be reduced. Hereby, even if the lip ring 20 is damaged, it is possible to lead portions other than the portion in the rocking direction D2 of the piston rod 11 to be damaged. Therefore, even in case that the lip ring 20 is damaged, the user can notice the damage of the lip ring 20 from decrease of pressure, and enables the repair before the rocking piston rod 11 comes into contact with the cylinder 10, so that it is possible to prevent surrounding damage due to the contact between the piston rod 11 and the cylinder 10.

Further, in a sidewall 31 of this ring holding member 30, a peripheral groove 32 is provided. As shown in FIG. 2(*b*), in this peripheral groove 32, a ring spring 40 is fitted. This ring spring 40 urges the lip ring 20 from the inside in order to seal surely clearance between the piston rod 11 and the cylinder 10. Namely, the outer diameter of this ring spring 40 is made slightly larger than the inner diameter of the lip portion 22 which the ring spring 40 comes into contact with. Hereby, the ring spring 40 urges the lip ring 20 so as to push the lip portion 22 toward the outside.

Figure 3:
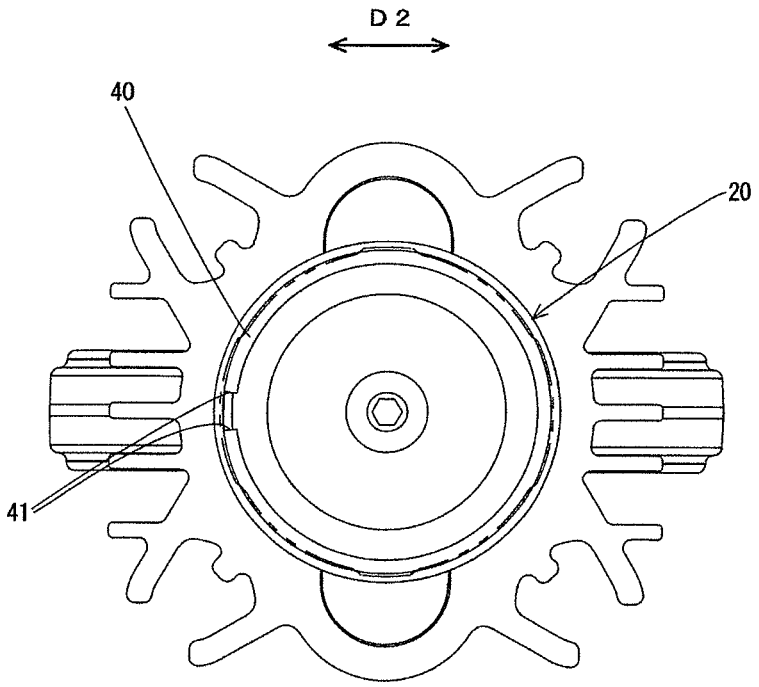
FIG. 3 is a partially enlarged view of a longitudinal section of the piston rod leading end portion of the first exemplary embodiment, showing a state where a ring holding member is detached.

This ring spring 40, as shown in FIG. 3, is partially cut in the circumferential direction, and formed in the C-shape having an end portion 41. This ring spring 40, as shown in FIG. 3, is arranged so that the end portion 41 is located in the locking direction D2 of the piston rod 11. Here, near the end portion 41 of this ring spring 40, the notch 34 is not provided in the flange portion 33 of the ring holding member 30. Therefore, the end portion 41 area of this ring spring 40, as shown in FIGS. 2 and 3, is covered with the flange portion 33 of the ring holding member 30. Therefore, even in case that the end portion 41 of the ring spring 40 expands to the outside due to the continuous use, since the notch 34 does not exist near this end portion 41, the ring spring 40 never comes out of the ring holding member 30.

As described above, according to the embodiment, at the upper portion of the ring holding member 30, the flange portion 33 is formed protrusively so as to cover at least a part of the upper end surface 23 of the lip portion 22. By thus covering at least a part of the upper end surface 23 of the lip portion 22 with the flange portion 33, the air is made difficult to enter the inside of the lip portion 22. Namely, provision of this flange portion 33 can prevent the rapid pressure variation and the compression heat which are produced by the reciprocating motion of the piton rod 11 from directly transmitting to the inner periphery portion of the lip ring 20, and can prevent deformation and abrasion of the lip ring 20. Further, since the notch 34 is provided in this flange portion 33, when the rocking piston slides in the compression direction, the pressurized air enters from this notch 34, and back pressure is applied to the lip ring 20 from the inner periphery thereof, so that seal performance of the lip ring 20 can be improved.

Namely, preventing inflow of the rapid pressure variation and compression heat can prevent the damage of the lip ring 20, while the application of the back pressure to the inner periphery of the lip ring 20 can be facilitated.

Figure 4A:
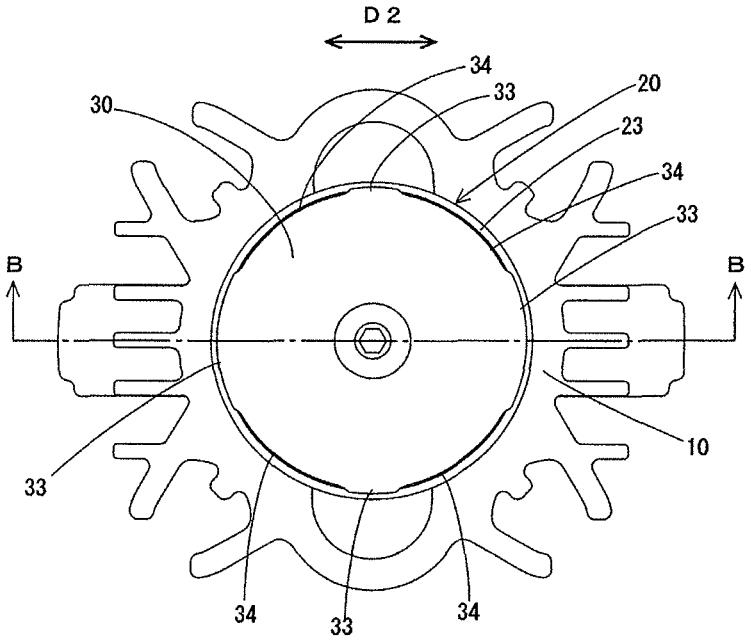
FIG. 4(*a*) is a plan view of a piston rod of a modified example of the first exemplary embodiment.
Figure 4B:
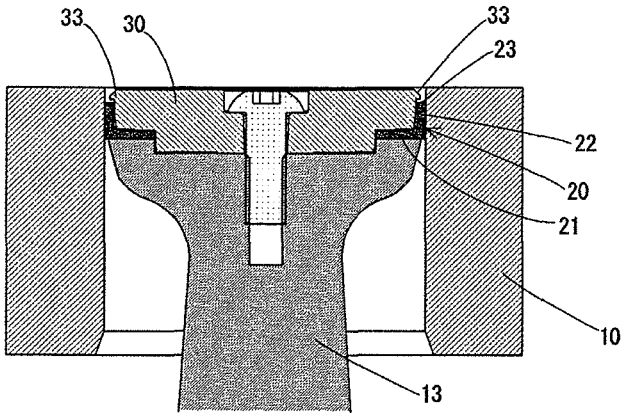

Further, as shown in FIG. 4, it is permissible that the ring spring 40 is not provided. Even in case that the ring spring 40 is not thus provided, the seal performance of the lip ring 20 can be improved by the back pressure.

(Second Exemplary Embodiment)

Next, a second exemplary embodiment of the invention will be described.

Since the basic structure of a rocking piston in the second exemplary embodiment is similar to that in the above-mentioned first exemplary embodiment, the same description is omitted, and only the feature of this embodiment will be described. Namely, the embodiment is characterized in that as a backpressure introducing portion, a through-hole 35 is provided in place of the notch 34 in the first exemplary embodiment.

Figure 5A:
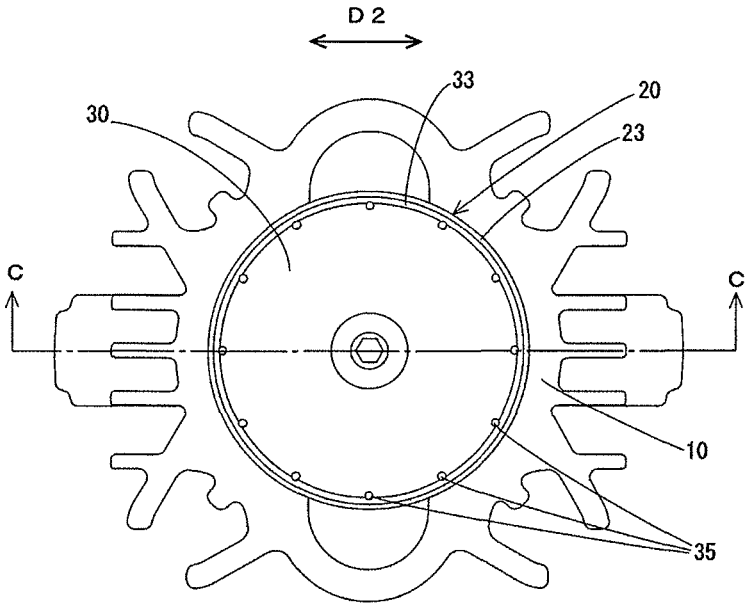
FIG. 5(*a*) is a plan view of a piston rod of a second exemplary embodiment.
Figure 5B:
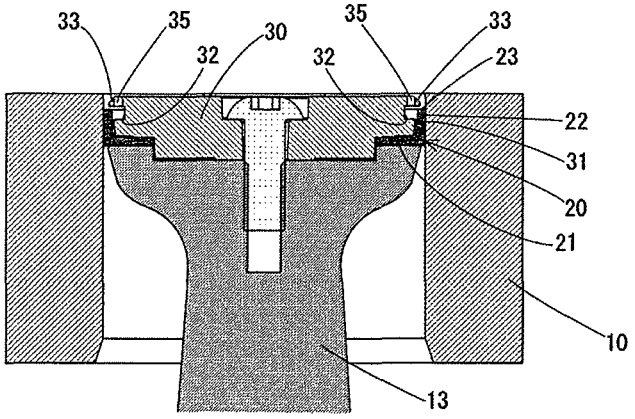

Namely, as shown in FIG. 5, also in the second exemplary embodiment, a flange portion 33 is formed at a peripheral edge of a ring holding member 30 upper portion. When projected in a direction vertical to the compression face (upper face) of the ring holding member 30, this flange portion 33 is extended up to the outside beyond the inner periphery edge of an upper end surface 23 of a lip portion 22. Although this point is similar to in the first exemplary embodiment, the second exemplary embodiment is different from the first exemplary embodiment in that round-type through-holes 35 are equally spaced in the circumferential direction in place of the notches 34.

This through-hole 35 extends through the flange portion 33 vertically in a sliding direction D1 of a piston rod 11, and communicates with a peripheral groove 32 provided in a sidewall 31 of the ring holding member 30 below. Therefore, when the rocking piston slides in the compression direction, the pressurized air enters from this through-hole 35 into the peripheral groove 32, and back pressure is applied to a lip ring 20 from the inner peripheral thereof, so that seal performance of the lip ring 20 can be improved.

Figure 6A:
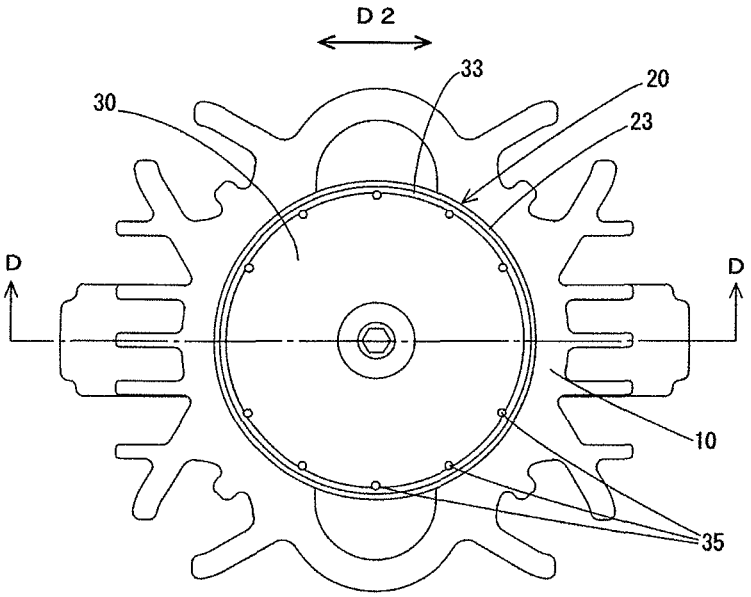
FIG. 6(*a*) is a plan view of a piston rod of a first modified example of the second exemplary embodiment.
Figure 6B:
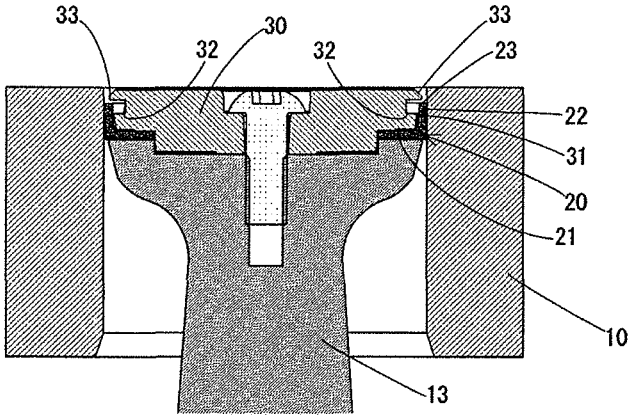

Further, although the through-holes 35 are equally spaced in the circumferential direction in the embodiment shown in FIG. 5, it is permissible that the through-holes 35 are not provided in a rocking direction D2 of the piston rod 11 as shown in FIG. 6. Thereby, as in the first exemplary embodiment, the speed at which the pressurized air enters in the rocking direction D2 of the piston rod 11 can be made low, so that a load due to rapid pressure variation and compression heat can be reduced.

Figure 7A:
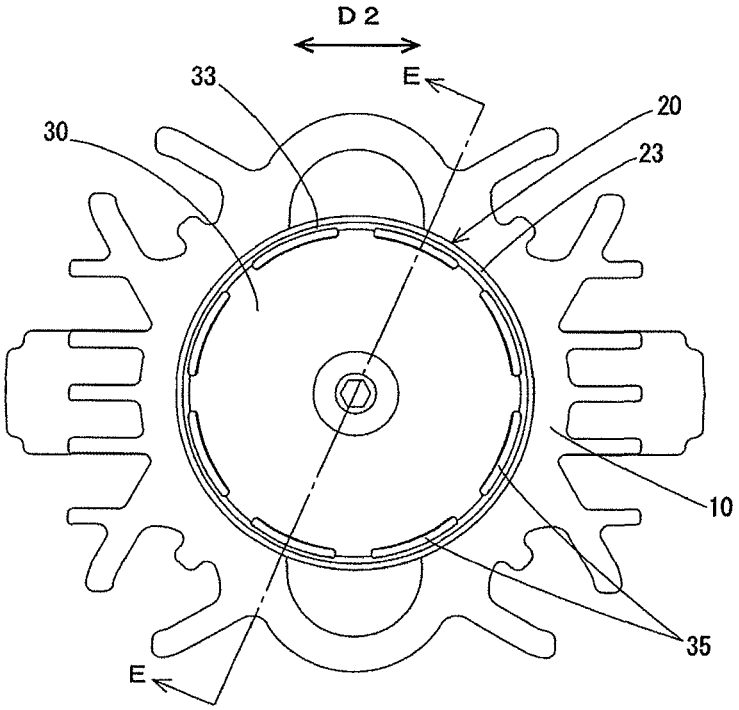
FIG. 7(*a*) is a plan view of a piston rod of a second modified example of the second exemplary embodiment.
Figure 7B:
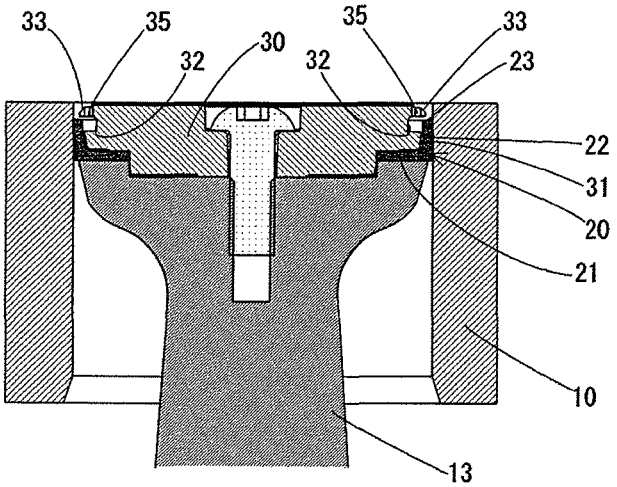

Further, although the shape of the through-hole 35 in the embodiment shown in FIG. 5 is round, the shape may be appropriately selected according to how much back pressure is applied. For example, as shown in FIG. 7, the through-hole 35 may be formed into a long hole.

Further, although reference to a ring spring 40 is not particularly made in the above embodiment, the ring spring 40 may be provided in the peripheral groove 32 as in the first exemplary embodiment to urge the lip ring 20 from the inside. At this time, it is desirable that the through-hole 35 is not provided near an end portion 41 of the ring spring 40. Hereby, even in case that the end portion 41 of the ring spring 40 expands to the outside due to the continuous use, the end portion 41 of the ring spring 40 is never caught in the through-hole 35.

As described above, also in the embodiment, as in the first exemplary embodiment, provision of the flange portion 33 can prevent the rapid pressure variation and the compression heat which are produced by the reciprocating motion of the piton rod 11 from directly transmitting to the inner periphery portion of the lip ring 20, and can prevent deformation and abrasion of the lip ring 20. Further, since the through-hole 35 is provided in this flange portion 33, when the rocking piston slides in the compression direction, the pressurized air enters from this through-hole 35, and the back pressure is applied to the lip ring 20 from the inner periphery thereof, so that seal performance of the lip ring 20 can be improved. Namely, preventing inflow of the rapid pressure variation and compression heat can prevent the damage of the lip ring 20, while the application of the back pressure to the inner periphery of the lip ring 20 can be facilitated.

(Third Exemplary Embodiment)

Next, a third exemplary embodiment of the invention will be described.

Since the basic structure of a rocking piston in the third exemplary embodiment is similar to that in the above-mentioned first exemplary embodiment, the same description is omitted, and only the feature of this embodiment will be described. Namely, the embodiment is characterized in that as a backpressure introducing portion, an opening 37 is provided in place of the notch 34 in the first exemplary embodiment.

Figure 8:
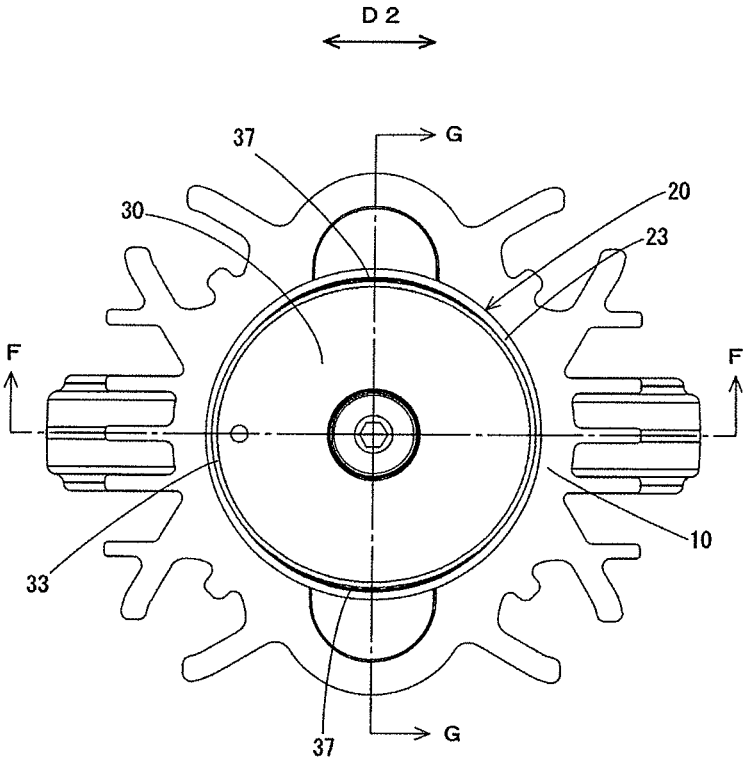
FIG. 8 is a plan view of a piston rod in a third exemplary embodiment.

Namely, as shown in FIG. 8, also in the third exemplary embodiment, a flange portion 33 is formed at a peripheral edge of a ring holding member 30 upper portion. This flange portion 33 is formed in the shape of an ellipse having a long axis in a rocking direction D2 of a piston rod.

Figure 9A:
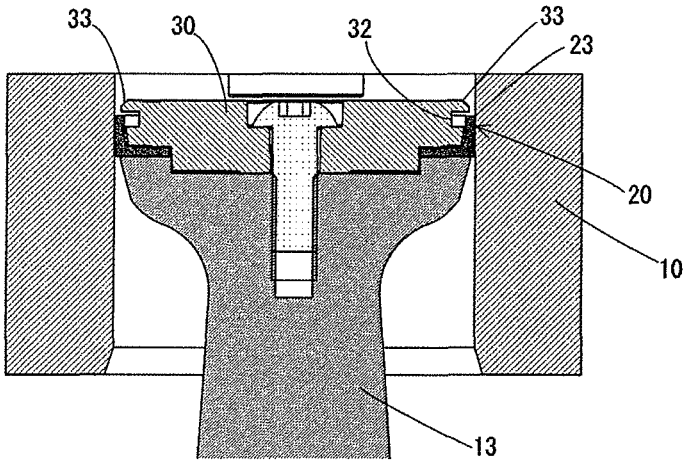
FIG. 9(*a*) is a partially enlarged view of a longitudinal section of a piston rod leading end portion (which is section taken along a line F-F in FIG. 8).
Figure 9B:
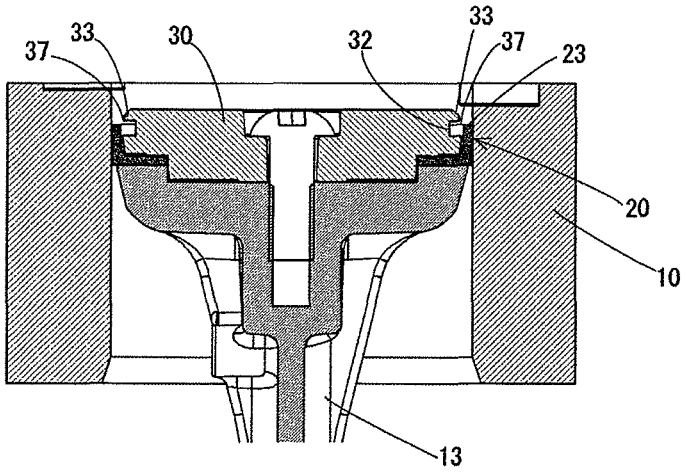

Specifically, this flange portion 33, as shown in FIG. 9(*a*), in the long axis direction of the elliptical shape, when projected in a direction vertical to the compression face (upper face) of the ring holding member 30, is extended up to the outside beyond the inner periphery edge of a upper end surface 23 of a lip portion 22.

On the other hand, in a short axis direction of the elliptical shape (direction orthogonal to the rocking direction D2 of the piston rod), as shown in FIG. 9(*b*), this flange portion 33, when projected in the direction vertical to the compression face (upper face) of the ring holding member 30, is located on the inside of the inner periphery edge of the upper end surface 23 of the lip portion 22. Hereby, the opening 37 from which the upper end surface of the lip portion 22 is exposed is provided. Therefore, when the rocking piston slides in the compression direction, the pressurized air enters from this opening 37 into a peripheral groove 32 provided in a sidewall 31 of the ring holding member 30, and back pressure is applied to a lip ring 20 from the inner peripheral thereof, so that seal performance of the lip ring 20 can be improved.

As described above, also in the embodiment, as in the first exemplary embodiment, provision of the flange portion 33 can prevent the rapid pressure variation and the compression heat which are produced by the reciprocating motion of the piton rod 11 from directly transmitting to the inner periphery portion of the lip ring 20, and can prevent deformation and abrasion of the lip ring 20. Further, since the opening 37 is provided in this flange portion 33, when the rocking piston slides in the compression direction, the pressurized air enters from this opening 37 into the peripheral groove 32, and the back pressure is applied to the lip ring 20 from the inner periphery thereof, so that the seal performance of the lip ring 20 can be improved. Namely, preventing inflow of the rapid pressure variation and compression heat can prevent the damage of the lip ring 20, while the application of the back pressure to the inner periphery of the lip ring 20 can be facilitated.

According to the above exemplary embodiments, the rocking piston type compressor may include the piston rod 11 which is slidable while rocking in a cylinder 10, the lip ring 20 provided at the leading end portion 13 of the piston rod 11 and configured to seal between the cylinder 10 and the piston rod 11, and the ring holding member 30 provided at the leading end portion 13 of the piston rod 11 and configured to fixing the lip ring 20 to the piston rod 11. The lip ring 20 may include the center portion 21 fixed by the ring holding member 30, and the lip portion 22 upwardly extending around the center portion 21 along a periphery of the ring holding member 30.

The ring holding member 30 may include the flange portion 33 covering at least the part of the upper end surface 23 of lip portion 22. The back pressure introducing portion 34, 35, 37 may be provided in a part of the flange portion 33.

In this structure, at the upper portion of the ring holding member, the flange portion is formed protrusively so as to cover at least apart of the upper end surface of the lip portion.

By thus covering at least a part of the upper end surface of the lip portion with the flange portion, the air is made difficult to enter the inside of the lip portion. Namely, provision of this flange portion can prevent rapid pressure variation and compression heat which are produced by the reciprocating motion of the piton rod from directly transmitting to the inner periphery portion of the lip ring, and can prevent deformation and abrasion of the lip ring. Further, since the back pressure introducing portion for making the pressurized air easy to enter the inside of the lip ring when the rocking piston slides in the compression direction is provided in a part of this flange portion, when the rocking piston slides in the compression direction, the pressurized air enters from this back pressure introducing portion, and the back pressure is applied to the lip ring from the inner periphery thereof, so that seal performance of the lip ring can be improved. Namely, preventing inflow of the rapid pressure variation and compression heat can prevent the damage of the lip ring, while the application of the back pressure to the inner periphery of the lip ring can be facilitated.

In the above structure, the back pressure introducing portion may comprise the notch 34, the opening 37, or the through hole 35 provided in the flange portion 33.

In the above structure, the back pressure introducing portion 34, 35, 37 may not be provided on the side in a rocking direction D1, D2 of the piston rod 11.

In this structure, in the rocking direction of the piston rod where the largest stress is produced by the reciprocating motion of the piston rod, the speed at which the pressurized air enters inside the lip ring can be made low, so that a load due to rapid pressure variation and compression heat can be reduced. Hereby, even if the lip ring is damaged, it is possible to lead portions other than the portion in the rocking direction of the piston rod to be damaged. Therefore, even in case that the lip ring is damaged, the user can notice the damage of the lip ring from decrease of pressure, and enables the repair before the rocking piston rod comes into contact with the cylinder, so that it is possible to prevent surrounding damage due to the contact between the piston rod and the cylinder.

In the above structure, the peripheral groove 32 may be provided in the sidewall 31 of the ring holding member 30. The ring spring 40 may fit in the peripheral groove 32. The lip ring 20 may be urged so as to be pushed out to the outside by the ring spring 40. The back pressure introducing portion 34, 35, 37 may not be provided in the vicinity of the end portion 41 of the ring spring 40.

In this structure, the seal performance of the lip ring can be improved by the ring spring. Further, the back pressure introducing portion is not provided near the end portion of the ring spring. Therefore, for example, in case that a notch or an opening is provided as the back pressure introducing portion, even if the end portion of the ring spring expands to the outside due to the continuous use, since the notch or the opening does not exist near this end portion, the ring spring never comes out of the ring holding member. Further, also incase that a through-hole is provided as the back pressure introducing portion, the end portion of the ring spring is never caught in the through-hole.

DESCRIPTION OF REFERENCE NUMERALS AND SIGNS

10 Cylinder
11 Piston rod
12 Bearing hole
13 Leading end portion
20 Lip ring
21 Center portion
22 Lip portion
23 Upper end surface
30 Ring holding member
31 Sidewall
32 Peripheral groove
33 Flange portion
34 Notch (Back pressure introducing portion)
35 Through-hole (Back pressure introducing portion)
36 Fixing bolt
37 Opening (Back pressure introducing portion)
40 Ring spring
41 End portion
D1 Sliding direction of piston rod
D2 Rocking direction of piston rod

What is claimed is:

1. A rocking piston type compressor comprising:
a piston rod which is slidable while rocking in a cylinder;
a lip ring provided at a leading end portion of the piston rod and configured to seal between the cylinder and the piston rod; and
a ring holding member provided at the leading end portion of the piston rod and configured to fix the lip ring to the piston rod by sandwiching the lip ring between the leading end portion of the piston rod and the ring holding member,
wherein the lip ring includes:
a center portion fixed to the piston rod by the ring holding member; and
a lip portion upwardly extending around the center portion along a periphery of the ring holding member and having an upper end surface to seal between the piston rod and an inner surface of the cylinder,
wherein the upper end surface includes both of (i) an inner periphery edge and (ii) an outer periphery edge which is in contact with an inner surface of the cylinder,
wherein the ring holding member includes a flange portion extending along the periphery of the ring holding member and covering a part of the upper end surface of the lip portion,
wherein a back pressure introducing portion is provided in a part of the flange portion where the flange portion does not cover the upper end surface of the lip portion, and
wherein the back pressure introducting portion is provided in a part of the flange portion that is disposed apart from a rocking direction of the piston rod.

2. The compressor according to claim 1, wherein the back pressure introducing portion comprises a notch provided in the flange portion.

3. The compressor according to claim 1, wherein the back pressure introducing portion comprises an opening provided in the flange portion.

4. The compressor according to claim 1, wherein the back pressure introducing portion comprises a through hole provided in the flange portion.

5. The compressor according to claim 1, wherein a peripheral groove is provided in a sidewall of the ring holding member, wherein a ring spring fits in the peripheral groove, wherein the lip ring is urged so as to be pushed out to an outside by the ring spring, and wherein the back pressure introducing portion is provided in a portion other than an end portion of the ring spring.

6. The compressor according to claim 1, wherein the upper end surface is only one surface.

* * * * *